United States Patent [19]

Patzelt et al.

[11] Patent Number: 5,024,754

[45] Date of Patent: Jun. 18, 1991

[54] SEPARATOR

[75] Inventors: Norbert Patzelt, Beckum; Michael von Seebach, Ennigerloh, both of Fed. Rep. of Germany

[73] Assignee: Krupp Polysius AG, Fed. Rep. of Germany

[21] Appl. No.: 446,397

[22] Filed: Dec. 5, 1989

[30] Foreign Application Priority Data

Dec. 22, 1988 [DE] Fed. Rep. of Germany ..... 3843338

[51] Int. Cl.[5] ..... B07B 0/83

[52] U.S. Cl. ..... 209/135; 209/148; 241/79

[58] Field of Search ..... 209/148, 134, 135; 214/19, 79, 79.1, 293

[56] References Cited

U.S. PATENT DOCUMENTS

| | | | |
|---|---|---|---|
| 4,059,507 | 11/1977 | Nobuo | 209/139.2 |
| 4,100,061 | 7/1978 | Eeckholt et al. | 209/139.2 |
| 4,388,183 | 6/1983 | Thomas | 209/139.2 |
| 4,689,140 | 8/1987 | Folsberg | 209/148 |
| 4,732,334 | 3/1988 | Müller et al. | 241/79.1 |
| 4,869,786 | 9/1989 | Hanke | 209/148 |
| 4,934,613 | 6/1990 | Kukuch | 241/79 |

*Primary Examiner*—Robert R. Song

*Attorney, Agent, or Firm*—Learman & McCulloch

[57] ABSTRACT

The invention relates to a separator with a rotor and a material distributor which are driven separately. Such a separator is particularly suitable for grinding plants which are equipped with a high-pressure grinding roll mill. The scabs discharged from such a roll mill can be broken up in a simple manner in the separator which acts simultaneously as a disagglomerator.

14 Claims, 6 Drawing Sheets

14

27
15
17
28
18
29
9
16
13
1
5
10
6
3
4
2
8
12
11

SEPARATOR

BACKGROUND OF THE INVENTION

The invention relates to a separator according to the preamble to claim 1.

A separator according to the preamble to claim 1 is known for example from EP-A-0 221 246. In this known separator the material distributor which is constructed as a plate is located immediately on the upper surface of the rotor and is rotatable together with the rotor.

The object of the invention is to construct a separator according to the preamble to claim 1 in such a way that it can be used advantageously in grinding plants which are equipped with a high-pressure grinding roll mill and in which the material for grinding discharged from the high-pressure grinding roll mill often contains a high proportion of fines.

This object is achieved according to the invention by the characterising feature of claim 1. Advantageous embodiments of the invention are the subject matter of the subordinate claims.

SUMMARY OF THE INVENTION

In the separator according to the invention the material distributor is driven independently of the rotor by means of a separate drive arrangement. Consequently the speed of rotation of the material distributor can be chosen so as to produce an optimum disagglomeration of the scabs. From the design point of view the material distributor is constructed according to the invention in such a way as to favour the breaking up of the material and the even feeding into the separating chamber.

DESCRIPTION OF THE DRAWINGS

The invention is explained in detail below with the aid of the drawings, in which.

DESCRIPTION OF THE INVENTION

Figure 1:
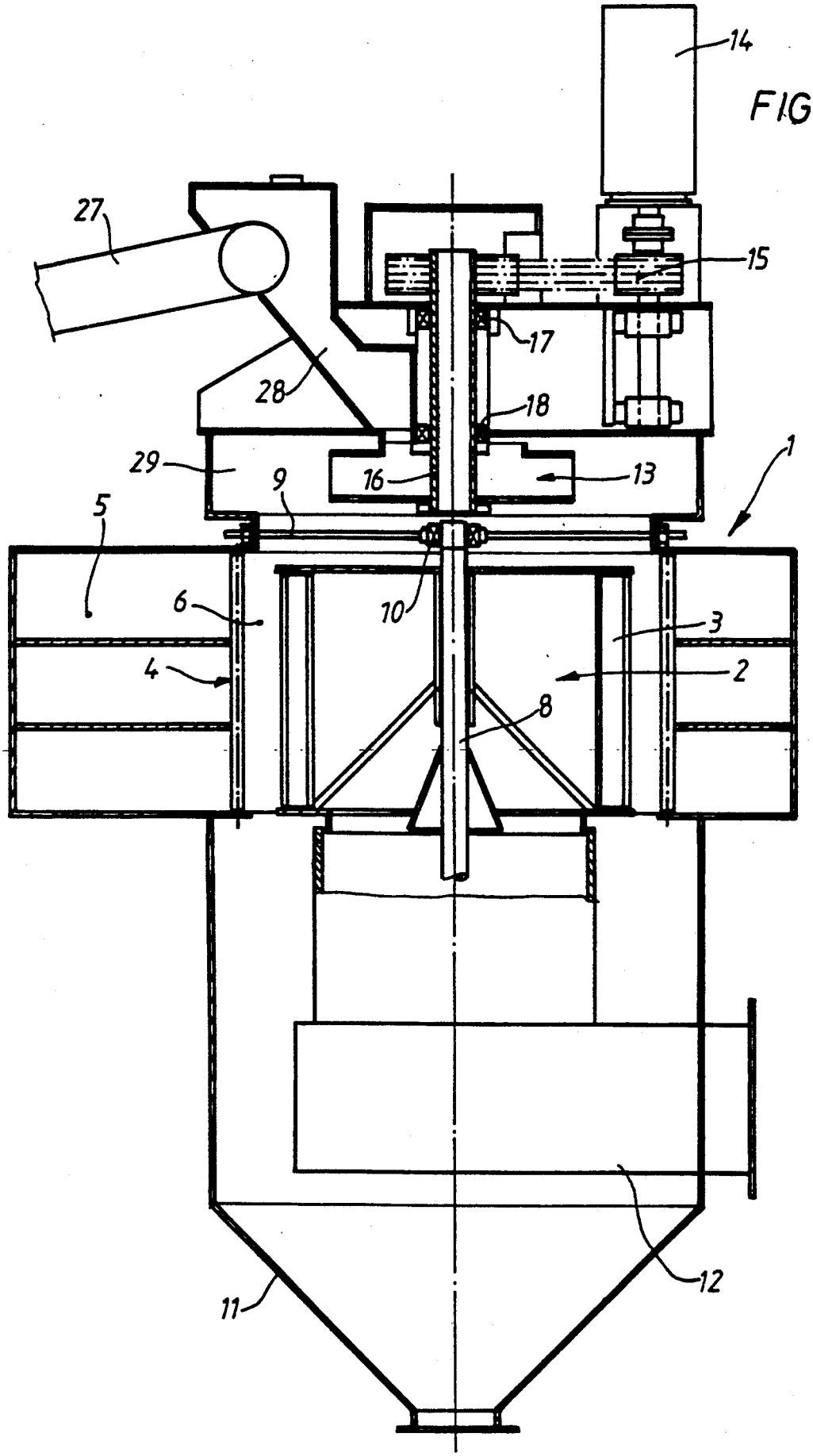
FIG. 1 shows a vertical section through one embodiment of the separator according to the invention.
Figure 2:
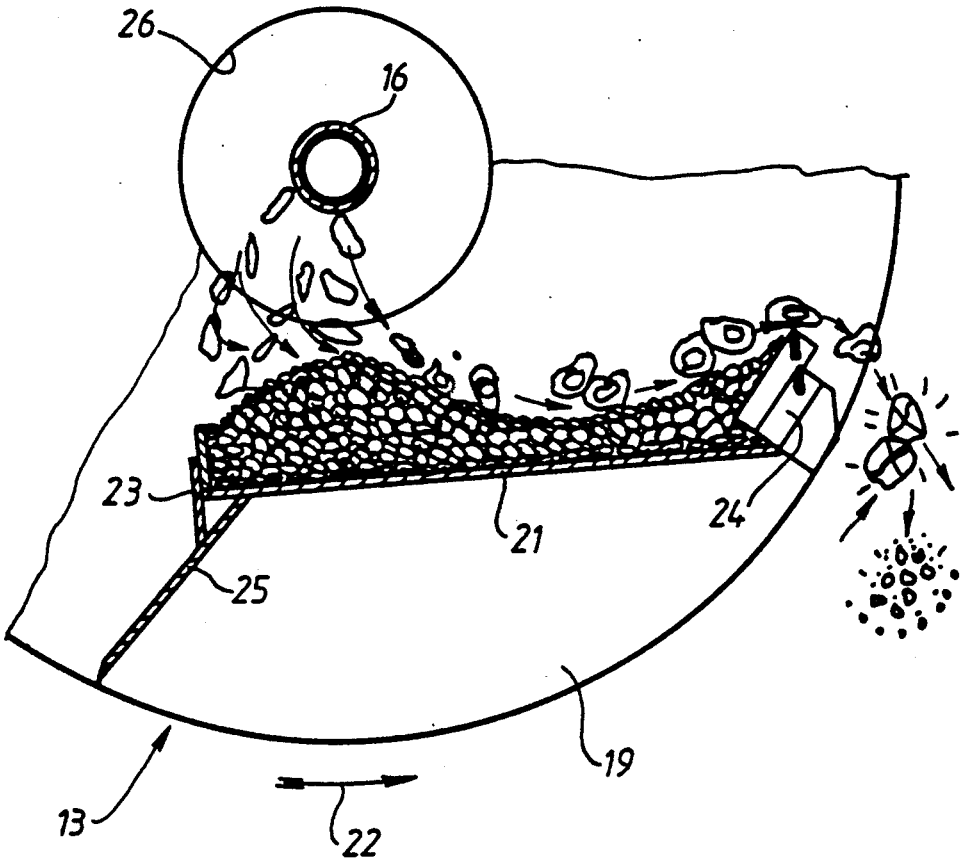
FIG. 2 shows a horizontal partial section through the material distributor.
Figure 3:
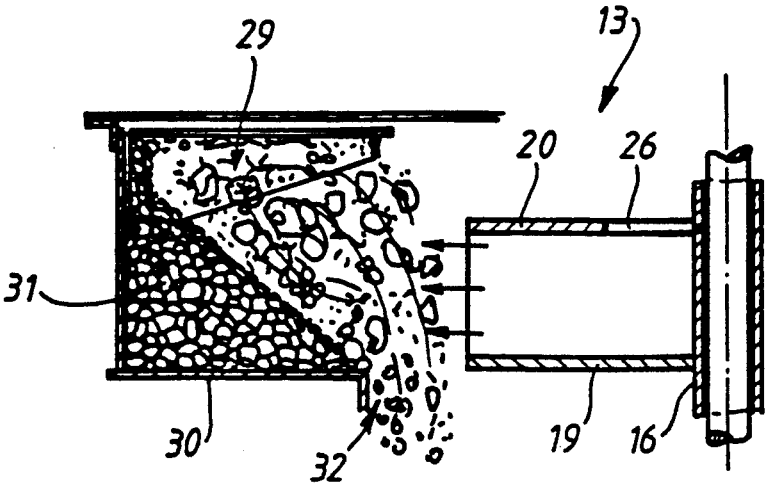
FIG. 3 shows a vertical partial section through the material distributor and the annular chamber surrounding it.

The separator 1 illustrated in FIGS. 1 to 3 contains a driven rotor 2 which has a vertical axis and has blades 3 arranged spaced from one another on its periphery.

The rotor 2 is surrounded by a stationary guide unit 4 which contains adjustable guide vanes and through which a stream of separating air delivered by means of an inlet spiral 5 enters the separating chamber 6 between the guide unit 4 and the rotor 2.

The rotor 2 is driven from below by a drive motor (not shown) via a shaft 8 which is mounted above the rotor 2 in a bearing 10 borne by radial crosspieces 9.

A tailings hopper 11 for removing the tailings falling out of the separating chamber 6 is located below the rotor 2 and the guide unit 4.

A channel 12 which serves to remove the stream of separating air which is charged with fines is connected to the open lower end of the rotor 2.

A material distributor 13 is arranged spaced above the rotor 2 and is driven independently of the rotor 2 by a separate drive motor 14 via a belt drive 15 and a hollow shaft 16. The hollow shaft 16 is mounted in bearings 17, 18.

The material distributor 13 contains a plate-shaped base plate 19 as well as an annular cover plate 20. A number of (for example three) guide bars 21 which are inclined with respect to the radial position in the direction of rotation (arrow 22) of the material distributor are arranged between the base plate 19 and the cover plate 20. Retaining elements 23, 24 are provided in the region of the ends of the guide bars 21. Support plates 25 support the guide bars 21 towards the exterior.

Between the annular cover plate 20 of the material distributor 13 and the shaft 16 there is an annular material inlet opening 26 through which the material which is delivered for example by means of a conveyor belt 27 and a feed chute 28 is delivered to the material distributor 13.

The material distributor 13 is surrounded with radial spacing by an annular chamber which is open towards the material distributor 13 and constitutes an impact and disagglomeration zone for the material thrown outwards by the material distributor 13. Since the annular chamber 29 has a base 30, a heap of material 31 on which the material thrown off by the material distributor 13 lands is formed in this annular chamber 29 and thus acts as protection against wear.

In a similar way there is also formed on the guide bars 21 of the material distributor 13—substantially aided by the damming effect exerted by the retaining elements 23, 24—a cushion of material which is struck by the particles of material entering the material distributor 13 through the material inlet opening 26 and accelerated outwards in the radial direction. In this way the wear on the surfaces which come into contact with the material agglomerates is substantially reduced.

To summarise, the separator according to FIGS. 1–3 functions as follows:

The material to be separated (preferably the material discharged from the high-pressure grinding roll mill) is delivered to the material distributor 13, accelerated by the latter into the annular chamber 29 and in this impact and disagglomeration zone is optimally broken up and homogenised. The material which is to a large extent broken up and homogenised falls through the gap 32 between the annular chamber 29 and the material distributor 13 into the separating chamber 6 between the guide unit 4 and the rotor 2. While the tailings fall downwards out of the separating chamber 6 and are removed via the tailings hopper 11, the fines are taken up from the stream of separating air by the rotor 2 and leave the separator via the channel 12 connected below the rotor 2.

The speeds of rotation (and also, if required, the direction of rotation) of the rotor 2 and the material distributor 13 can be chosen so as to be different so that both the disagglomeration and the separation can be optimally set and adapted to the particular material in question.

As a variant of the embodiment illustrated in FIG. 1, several feed chutes 28 can be arranged if required (preferably evenly distributed over the periphery). Instead of a conveyor belt 27 with a feed chute 28 arranged after it, screws can also be provided for example for delivery of the material for grinding.

FIGS. 4 to 8 show some embodiments of grinding plants with the separator according to the invention.

Figure 4:
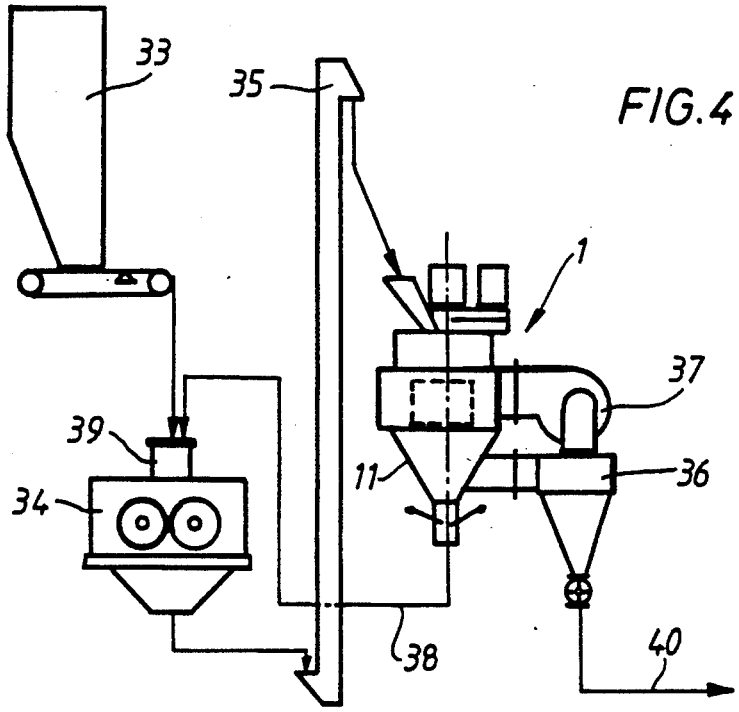
FIGS. 4 to 8 show schematic representations of grinding plants with the separator according to the invention.

The grinding plant according to FIG. 4 contains a feed bin 33, a high-pressure grinding roll mill 34, a circulating elevator 35, a separator 1 (according to FIGS. 1-3) which is simultaneously constructed as a disagglomerator, a precipitator 36 and a circulating fan 37.

In the case of the grinding plant according to FIG. 4, the tailings discharged via the tailings hopper 11 of the separator 1 are led back via a return 38 to the inlet shaft 39 of the high-pressure grinding roll mill 34. The fines precipitated out of the stream of separating air in the precipitator 36 form the finished material (line 40). Thus the grinding plant according to FIG. 4 shows a diagram of purely closed-circuit grinding with a high-pressure grinding roll mill 34. Since the scabs discharged from the roll mill 34 are broken up in the material distributor of the separator 1, it is not necessary to have a separate disagglomerating arrangement; at the same time the conveying distance is shortened.

Figure 5:
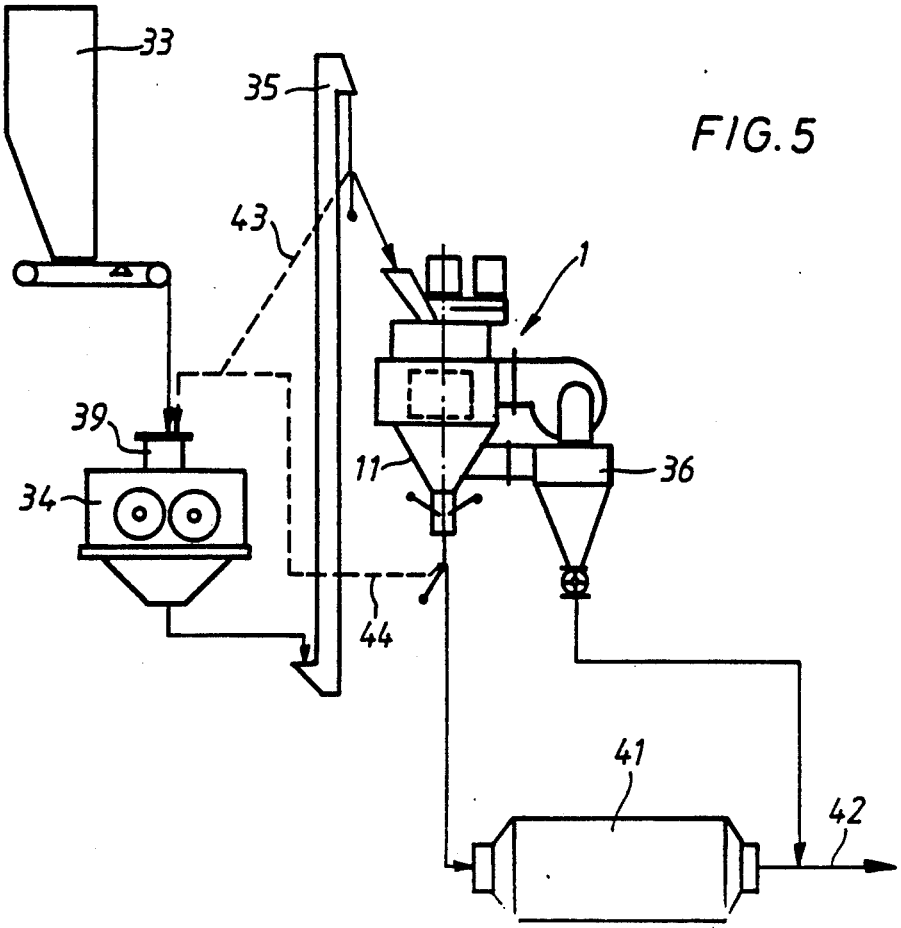

In the embodiment according to FIG. 5, in addition to the elements of the grinding plant which have already been explained with the aid of FIG. 4 there is provided a fine grinding mill which is preferably constructed as a tube mill 41 and to which the tailings discharged via the tailings hopper 11 of the separator 1 are delivered. The total discharge from the tube mill 41 and the precipitator 36 forms the finished material (line 42).

Return lines 43, 44 which are indicated by broken lines in FIG. 5 are also provided by means of which material discharged—alternatively or additionally—from the high-pressure grinding roll mill 34 (return line 43) and/or material discharged via the tailings hopper 11 of the separator 1 (return line 44) can be led back to the inlet shaft 39 of the high-pressure grinding roll mill 34.

Thus FIG. 5 shows a grinding plant with preliminary grinding in the high-pressure grinding roll mill 34 and fine grinding in the open-circuit tube mill 41, alternatively with tailings and/or scabs returned to the high-pressure grinding roll mill. In this case too the disagglomeration of the scabs which takes place in the separator 1 produces a substantial simplification of the plant and a marked reduction in the operating costs.

Figure 6:
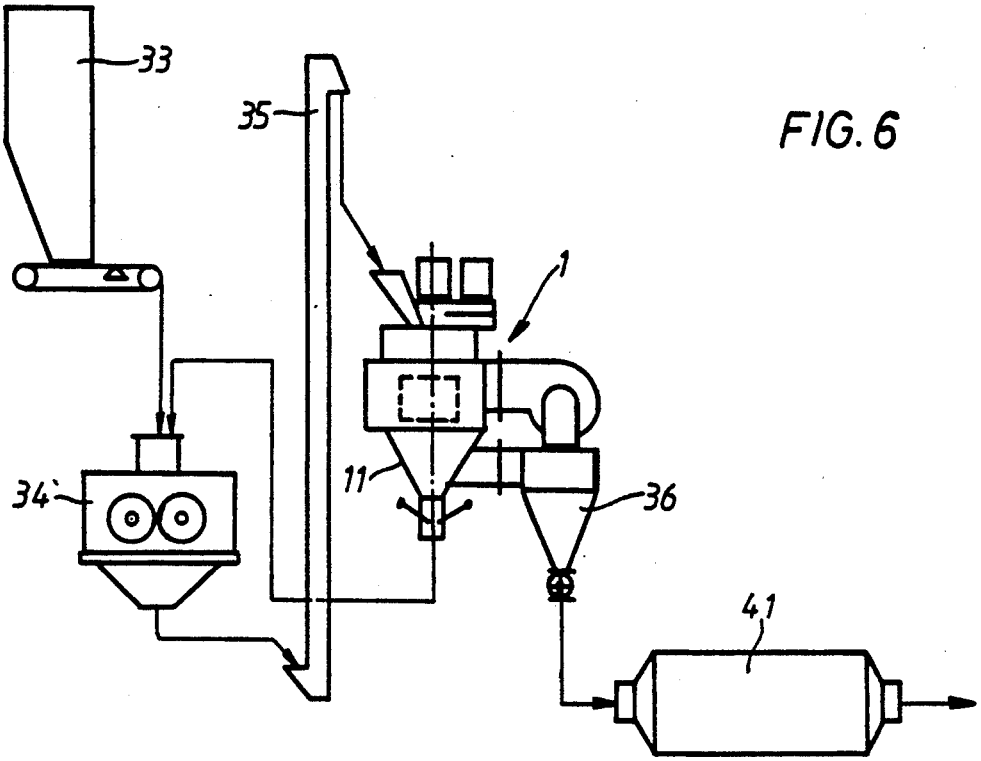

The grinding plant illustrated in FIG. 6 contains the same elements as the plant according to FIG. 5. As in the grinding plant according to FIG. 4, all of the tailings discharged via the tailings hopper 11 of the separator 1 are returned to the high-pressure grinding roll mill 34, whereas the material precipitated in the precipitator 36 is subjected to further grinding in the tube mill 41.

Figure 7:
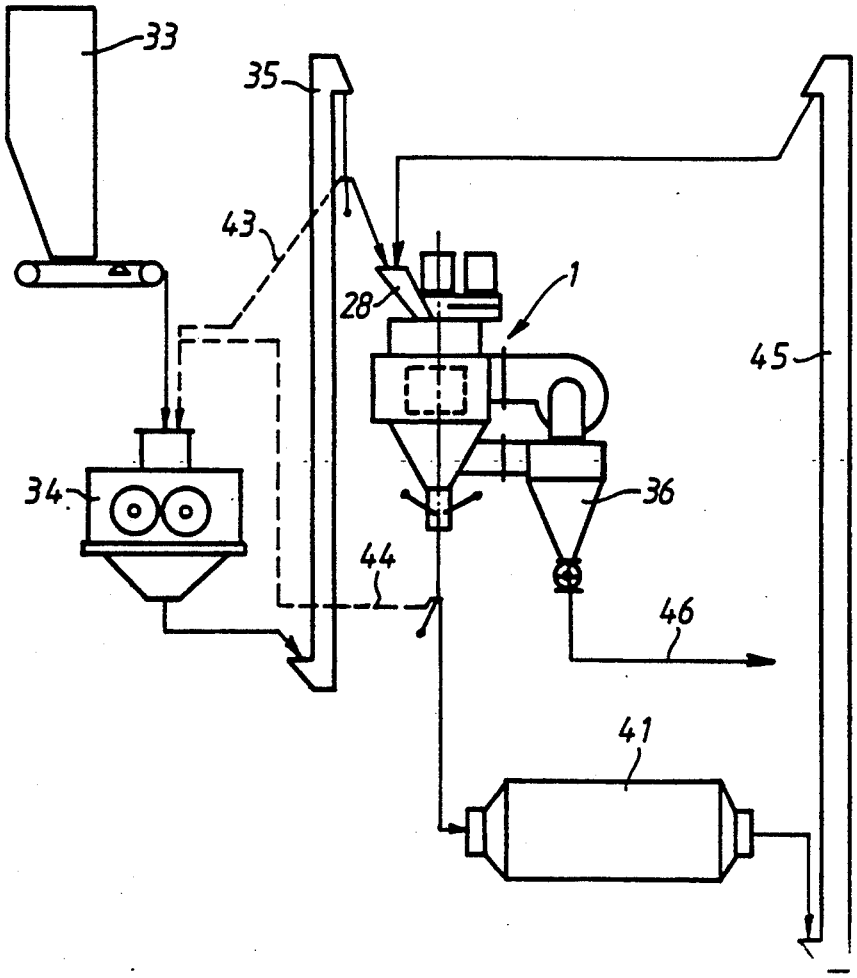

The grinding plant according to FIG. 7 contains the same elements as the plants according to FIGS. 5 and 6. A circulating elevator 45 is additionally provided which returns the discharge from the tube mill 41 to the feed chute 28 of the separator 1 so that together with the material discharged from the high-pressure grinding roll mill 34 it reaches the material distributor 13 of the separator 1. The finished material is removed from the precipitator 36 (line 46).

As in the embodiment according to FIG. 5, return lines 43 and 44 are provided which can be used alternatively or additionally and by means of which the material discharged from the high-pressure grinding roll mill 34 or tailings from the separator 1 are returned to the roll mill 34.

Figure 8:
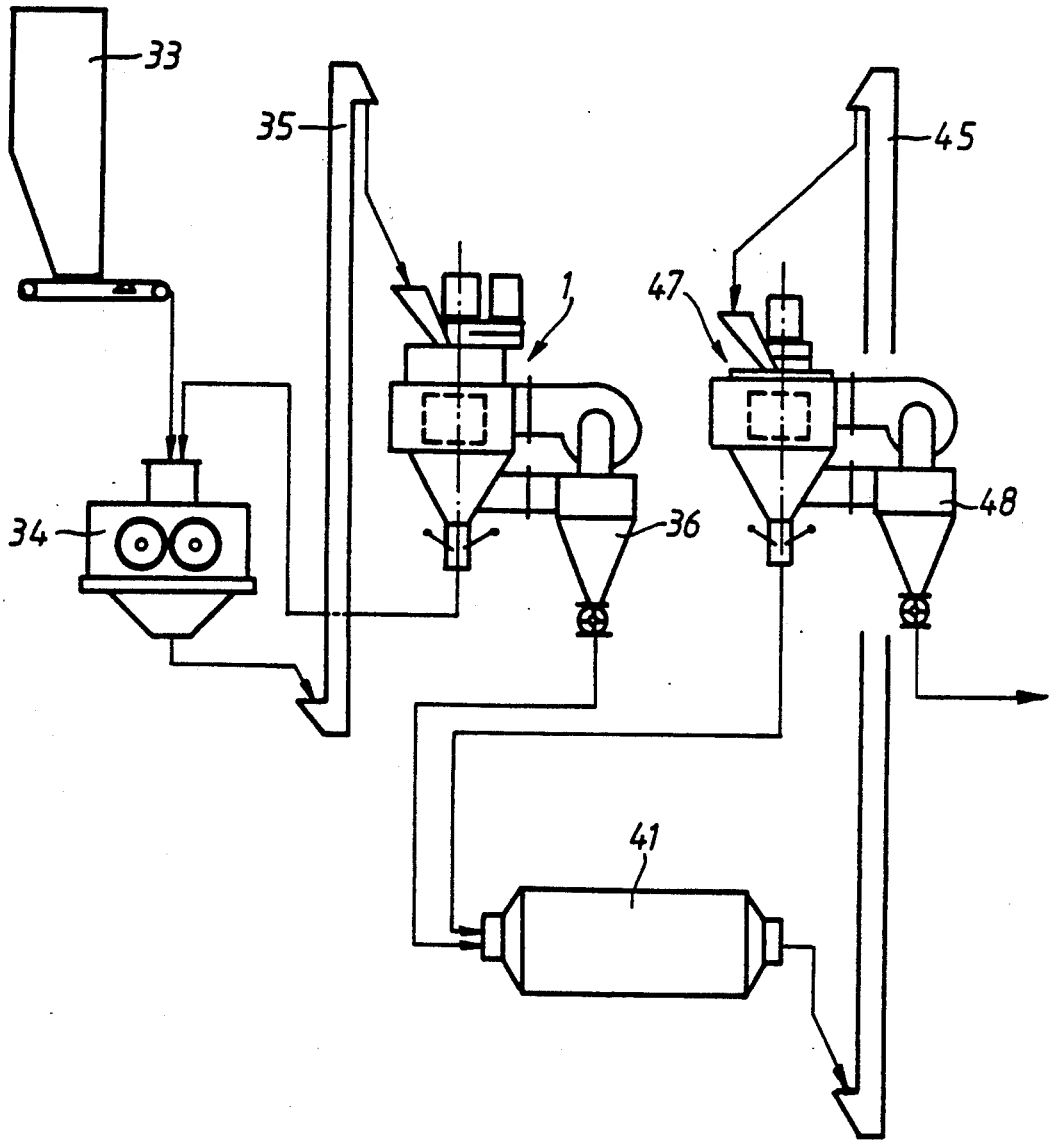

Finally, FIG. 8 shows a grinding plant which contains, in addition to the components illustrated in FIG. 5, a circulating elevator 45, a further separator 47 and a precipitator 48. In this case the separator 47 is—unlike the separator 1—constructed in the conventional manner, i.e. provided with one single drive motor by means of which the rotor and a suitably constructed distributor plate are driven.

The material for grinding which is is discharged from the tube mill 41 is delivered via the circulating elevator 45 to the separator 47. The tailings precipitated in the separator 47 are again passed (together with the material discharged from the precipitator 36) to the tube mill 41, whilst the fines discharged from the separator 47 form the finished material after precipitation in the precipitator 48. Thus in the case of the grinding plant according to FIG. 8 closed-circuit grinding takes place with the high-pressure grinding roll mill 34 (tailings circulating) and fine grinding with the tube mill 41 (fines circulating).

Figure 9:
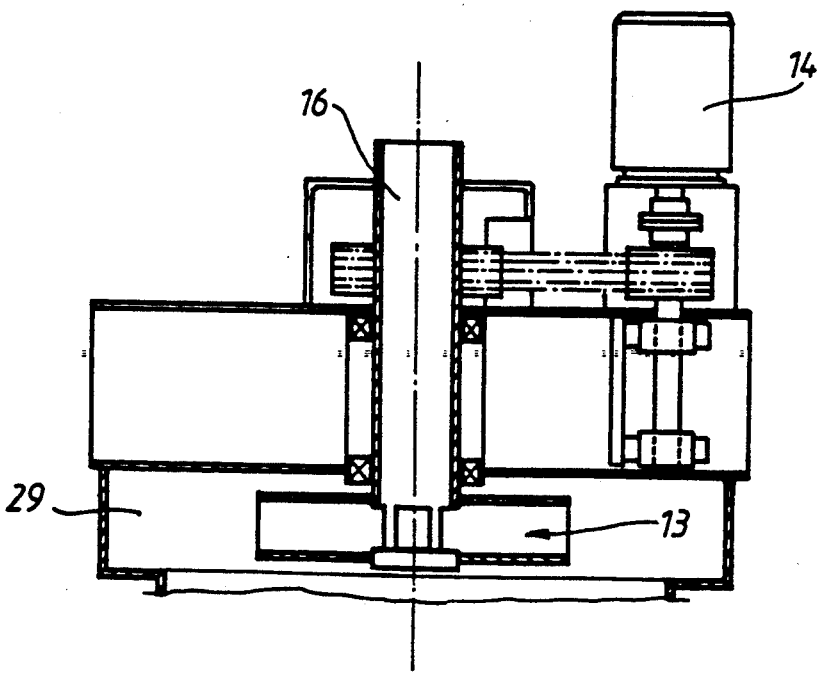
FIG. 9 shows a variant of the separator (detail view).

FIG. 9 shows a variant of the material feed onto the material distributor 13 which is particularly suitable for larger constructions. In this case the material is delivered via the shaft 16, which is of suitably large dimensions, by means of which the material distributor is driven by the drive motor 14. Thus the material arrives centrally on the material distributor 13 and is accelerated outwards by the latter in the manner already described and disagglomerated in the annular chamber 29.

We claim:

1. A separator comprising (a) a driven rotor having a vertical axis and blades spaced from one another about its periphery, (b) rotatable material distributor means above the rotor, (c) means for delivering material to be separated to the material distributor means, (d) a stationary guide unit encircling the rotor with a clearance therebetween and having adjustable guide vanes, a separating chamber between the guide unit and the rotor for receiving material thrown off by the material distributor means and through which may pass a stream of separating air delivered through the guide unit and drawn off through the rotor so as to entrain fines, (e) a channel connected to one end of the rotor for removal of the stream of separating air and entrained fines, (f) a tailings hopper below the rotor and the guide unit (4) for removal of tailings, characterized in that:

(g) the material distributor is driven independently of the rotor by separate drive means for radially discharging the material to be separated, and (h) an annular chamber radially encircling and radially spaced from the material distributor means, said chamber being open toward the material distributor means to form a material impact and disagglomeration zone for receiving the material discharged from the material distributor means and in which zone a heap of material may form to protect against wear of the chamber.

2. Separator as claimed in claim 1, characterised in that the material distributor (13) contains the following elements:

(a) a plate-shaped base plate (19), (b) a number of guide bars (21) which are arranged on the base plate and are inclined with respect to the radial position in the direction of rotation of the material distributor, (c) retaining elements (23, 24) to build up a cushion of material on the guide bars (21).

3. Separator as claimed in claim 2, characterised in that the material distributor (13) has an annular cover plate (20) and an annular material inlet opening (26) is provided between the cover plate (20) and the drive shaft (16).

4. A separator as claimed in claim 1, characterized in that the drive shaft of the material distributor means is constructed as a hollow shaft having an interior passage for receiving the material to be separated, said passage being in material flow communication with the material distributor means so as to supply the material thereto for subsequent discharge to the chamber.

5. Grinding plant containing (a) a high-pressure grinding roll mill (34) with two rolls pressed against one another under high pressure, (b) as well as a separator (1) for separating the material comminuted in the roll mill, characterised by a sifter as claimed in claim 1.

6. Grinding plant as claimed in claim 5, characterised in that a return line (38) is provided for returning the tailings discharged via the tailings hopper (11) of the separator (1) to the roll mill (34).

7. Grinding plant as claimed in claim 5, characterised by the following features:

(a) return lines (43, 44) are also provided which can be used alternatively or additionally and by means of which the material discharged from the high-pressure grinding roll mill (34) and via the tailings hopper (11) of the separator (1) can be returned to the roll mill.

8. Grinding plant as claimed in claim 7, characterised by a further return line by means of which the material discharged from the fine grinding mill is again delivered to the separator (1).

9. Grinding plant as claimed in claim 6, characterised by a fine grinding mill which is preferably constructed as a tube mill (41) for regrinding material discharged from the separator (1) as fines.

10. Grinding plant as claimed in claim 9, characterised by a further return line by means of which the material discharged from the fine grinding mill (41) is delivered to a further separator (47) with an individual drive.

11. A separator comprising:

(a) a driven rotor having a vertical axis and blades spaced from one another about its periphery, (b) rotatable material distributor means above the rotor, (c) means for delivering material to be separated to the material distributor means, (d) a stationary guide unit encircling the rotor with a clearance therebetween and having adjustable guide vanes, a separating chamber between the guide unit and the rotor for receiving material thrown off by the material distributor means and through which may pass a stream of separating air delivered through the guide unit and be drawn off through the rotor so as to entrain fines, (e) a channel connected to one end of the rotor for removal of the stream of separating air and entrained fines, (f) a tailings hopper below the rotor and the guide unit for removal of tailings, (g) separate drive means for driving the material distributor means independently of the rotor, (h) said material distributor means comprising a plate-shaped base plate, a plurality of guide bars on the base plate and inclined with respect to the radius of said plate in the direction of rotation of the material distributor means, and retaining elements for building up a cushion of material on the guide bars.

12. A separator as claimed in claim 11, characterized in that the material distributor includes an annular cover plate and an annular material inlet opening between the cover plate, and a drive shaft.

13. A separator as claimed in claim 11, characterized in that the annular chamber is closed at its bottom by a base for supporting the heap of material therein.

14. A separator as claimed in claim 11, characterized in that said annular chamber is radially opposed to the material distributor means to form a gap therebetween through which material may fall to the separating chamber.

* * * * *

UNITED STATES PATENT AND TRADEMARK OFFICE

CERTIFICATE OF CORRECTION

PATENT NO. : 5,024,754

DATED : June 18, 1991

INVENTOR(S) : Norbert Patzelt and Michael von Seebach

It is certified that error appears in the above-identified patent and that said Letters Patent is hereby corrected as shown below:

Column 6, line 22, after "tailings," insert

-- characterized in that: --.

Signed and Sealed this

Twentieth Day of October, 1992

*Attest:*

DOUGLAS B. COMER

*Attesting Officer*

*Acting Commissioner of Patents and Trademarks*